US005623973A

United States Patent [19]

Josefsson

[11] Patent Number: 5,623,973

[45] Date of Patent: Apr. 29, 1997

[54] WEFT-THREAD MEASURING FEEDER HAVING A CIRCUMFERENCE ADJUSTING SPREADING BODY

[75] Inventor: Paer Josefsson, Borås, Sweden

[73] Assignee: Iro AB, Ulricehamn, Sweden

[21] Appl. No.: 454,259

[22] PCT Filed: Nov. 29, 1993

[86] PCT No.: PCT/EP93/03348

§ 371 Date: Jul. 28, 1995

§ 102(e) Date: Jul. 28, 1995

[87] PCT Pub. No.: WO94/12710

PCT Pub. Date: Jun. 9, 1995

[30] Foreign Application Priority Data

Dec. 3, 1992 [DE] Germany ..... 42 40 709.5

[51] Int. Cl.[6] ..... D03D 47/36

[52] U.S. Cl. ..... 139/452

[58] Field of Search ..... 139/452; 242/47.01

[56] References Cited

U.S. PATENT DOCUMENTS

| | | | |
|---|---|---|---|
| 4,462,434 | 7/1984 | Takegawa | 139/452 |
| 4,643,369 | 2/1987 | van Donk | 139/452 X |
| 4,645,134 | 2/1987 | Sarfati | 139/452 X |
| 5,046,537 | 9/1991 | Maina | 139/452 |
| 5,370,158 | 12/1994 | Ogata et al. | 139/452 |
| 5,377,922 | 1/1995 | Fredriksson et al. | 139/452 X |

FOREIGN PATENT DOCUMENTS

| | | |
|---|---|---|
| 0060234A1 | 9/1982 | European Pat. Off. . |
| 0253359A2 | 1/1988 | European Pat. Off. . |
| WO92/01101 | 1/1992 | WIPO . |

*Primary Examiner*—Andy Falik

*Attorney, Agent, or Firm*—Flynn, Thiel, Boutell & Tanis, P.C.

[57] ABSTRACT

A weft-thread measuring feeder comprising a storage drum for a thread stock consisting of tangentially wound turns, from which a thread can be withdrawn overend in sections of a predetermined length. The storage drum includes a power accumulator which can be triggered from outside the storage drum for temporarily extending a spreading body which is positioned below the turns of thread stock and is defined circumferentially.

19 Claims, 3 Drawing Sheets

WEFT-THREAD MEASURING FEEDER HAVING A CIRCUMFERENCE ADJUSTING SPREADING BODY

FIELD OF THE INVENTION

The present invention relates to a weft-thread measuring feeder comprising a storage drum having radially adjustable segments which vary a circumferential length around the drum, and a stop element for dimensioning a thread length of thread being withdrawn from the drum. Alternately, the drum may be invariable and a stop device provided having a plurality of stop elements distributed evenly about the drum circumference.

BACKGROUND OF THE RELATED ART

EP-A-0 060 234 and EP-A-0 253 59 each disclose a measuring feeder whose storage drum consists of a plurality of circumferentially separated segments. Some of the segments can be adjusted radially asymmetrically relative to the storage drum axis to vary the circumferential length of the storage drum. The stop device contains only a single stop element which can be disengaged to release the thread for withdrawal and can be engaged again shortly before the predetermined thread length is reached in order to dimension the thread length. In the measuring feeder according to EP-A-0 253 359, an actuator is provided for adjusting the segments also during operation so as to adjust or readjust the correct thread length.

EP-A-0 253 359 describes a measuring feeder whose storage drum has an invariable diameter and a fixed circumferential length. The stop device contains a plurality of stop elements which are distributed circumferentially over the storage drum and which can individually be actuated via a control device to compose the predetermined thread length of whole turns or of fractions thereof which can be set by the circumferential distances of the stop elements.

In storage drums of an invariable diameter and in storage drums of a variable diameter, the thread length is set such that attention is paid to the reduction which is due to the thread tension stored in the elastic turns upon relaxation of the withdrawn thread section. In weft-thread measuring 3 feeders of a storage drum of the two above-mentioned types, a high speed level and/or a high thread tension will be observed during weft mixing weaving when in case of a defective feeder (thread breakage) another feeder assumes the function of the defective feeder. In each type of storage drum, a high speed level can also arise with drastic pattern variations during pattern weaving for a short time. Furthermore, an influence of the diameter of the supply bobbin on the withdrawal tension of the thread from the bobbin (or the other words, the winding tension of the thread onto the storage drum) can always be felt, i.e., the thread tension increases with a decreasing bobbin diameter. The higher the speed level and/or the stronger the resistance to withdrawal from the supply bobbin in comparison with normal operation, the stronger becomes the tension in the turns in the thread stock and the stronger is the reduction in the withdrawn relaxed thread section. That is why the thread length is set with a view to the strongest reduction to be expected to avoid short picks that lead to expensive standstill periods of the machines. This, however, means a great amount of waste caused by long free thread ends to be cut off during a considerable portion of the operation. In a weft-thread measuring feeder comprising a storage drum of an invariable diameter and a plurality of stop elements, the thread length can only be adjusted in steps which depend on the pitches of the stop elements. The pitches are limited for constructional reasons and for reasons of costs. In some cases the set thread length is therefore longer than the thread length actually required, which means an expensive waste of thread material.

It is the object of the present invention to provide a weft-thread measuring feeder either of the variable diameter type or the invariable diameter type which is of a simple construction and functions in a reliable manner and in which independently of the type of storage drum the thread length can be adjusted in an optimally short and accurate manner with a view to as little waste of thread material as possible and without the risk of short picks.

SUMMARY OF THE INVENTION

This object is attained according to the invention in either in either a variable diameter type storage drum or an invariable type storage drum which include an axially elongate spreading body disposed radially inwardly of the thread stock so as to define a fraction or portion of the total circumferential length of the drum. The drum includes a triggerable extension-type power accumulator for moving the spreading body relative to the circumferentially adjacent portions of the drum circumference between a retracted passive position and a spreading position disposed radially outwards of the circumferentially adjacent drum portions.

In the measuring feeder of the variable diameter storage drum type, the thread length can be set in an optimally short and accurate manner by means of the radially adjustable segments, since in the case of a high speed level and/or a high thread withdrawal tension of thread from the bobbin the spreading body is extended temporarily and rapidly to increase the turns on the storage drum for this operating condition, whereby the strong reduction of the withdrawn thread section during relaxation thereof is substantially compensated for. The constructional and technical controlling concepts of the measuring feeder remain substantially unchanged. The extension of the spreading body by means of the power accumulator is so fast that an immediate adaptation to the changing operating situation is possible. In addition to the diameter adjustability which is per se given, the spreading body works with its power accumulator and permits an additional rapid increase in the thread length during operation when the risk of short picks arises at the thread length which is set to be short with a view to little waste. A small lift of the spreading body which may be adjustable in advance is sufficient. The normal diameter adjustability by means of the radially adjustable segments would be too slow for such a rapid adjustment.

In the measuring feeder of the type with an invariable circumferential length of the storage drum, the thread length can be graduated more finely with aid of the spreading body even at large pitches between the stop elements because it is possible to increase the pitches at least between some stop elements with the aid of the spreading body. The constructional efforts for modifying the storage drum are small. Furthermore, the spreading body is rapidly extended at an instantaneous high speed level and/or at an increasing thread withdrawal tension of thread from the supply bobbin to increase the turns on the storage drum so as to compensate the strong reduction to be expected upon relaxation of the withdrawn thread section. The winding length is expediently increased in at least one step, namely temporarily, i.e., only for the operating condition which is critical for the observance of the set thread length.

A constructionally simple embodiment is provided where the storage drum is designed as a rod cage having a plurality of axially extending fingers which are spaced circumferentially.

The movement variants is provided wherein the spreading body is moveable radially away from the storage drum axis which is oriented parallel thereto, or is moveable about a pivotal axis oriented perpendicular to the longitudinal axis of the drum yield the same result in different ways, i.e., an adjustment of the winding length in the thread stock.

An advantageous embodiment for both types of storage drums includes a power accumulator which is a spring element that biases about a pivot axis the spreading body formed as an axial finger. An automatically latching lock also is included which is releasable against the action of the spring and fixes the spreading body in a passive position. The power accumulator which is arranged in the storage drum moves the spreading body almost abruptly into the spreading position to counteract a critical situation with respect to the thread length. In the passive position the spreading body can be part of the storage drum circumference or may even be reset relative thereto. The spring element is supported on the arm of the spreading body and may be relatively strong.

The spreading body can be an advance element and has a coupling element which is movable against the action of the spring into an entrainment position and pivots the spreading body into the spreading position.

The advance element which is driven in a wobbling manner relative to the storage drum assumes a double function because it uses its motional energy for extending and possibly resetting the spreading body.

According to a further embodiment permanent or switching magnets are used, or at least one permanent magnet is used as a power accumulator. This ensures a rapid movement of the spreading body into the spreading position and a fixed mounting of the spreading body in the spreading position.

According to a still further embodiment the spreading body is a flap which is pivoted outwards about an axis which is approximately in parallel with the drum axis. The flap is biased by the power accumulator which is formed as a spring element.

In another embodiment, a trigger is spaced above the outer circumferential surface of the drum which is operable between picking cycles for triggering the power accumulator with an electromagnetic, electromotive, piezoelectric, magnetostrictive, mechanical, pneumatic or hydraulic drive. The trigger can be controlled and operated from the outside and can be made operative either between the turns and therethrough or in an area outside the thread stock. This also takes into account the fact that a direct corporeal access to the storage drum is not possible from the outside because of the winding motion of the thread, the forwardly traveling thread stock and the rotatingly withdrawn thread, except the access between two thread passages or between the thread turns which advance at a relatively slow pace.

Resetting means also can be provided to act on the spreading body extended into the spreading position. The resetting means can be provided with an electromagnetic, electromotive, piezoelectric, magnetostrictive, mechanical, pneumatic or hydraulic drive. The spreading body also can be reset by hand. The resetting means has enough time to move the spreading body into the passive position when the critical situation is over. The indicated drives can be controlled accurately and permit rapid and precise movements.

According to a further embodiment where an auxiliary drive is provided at the trigger and the trigger is formed as resetting means, the trigger has a double function because it triggers and resets the spreading body.

As for a contactless signal transmission or a contactless triggering for example, with a radio signal, magnetically, by infrared light or by ultrasonic sound, no attention has to be paid to the moving thread.

BRIEF DESCRIPTION OF THE DRAWINGS

Embodiments of the subject matter of the invention shall now be explained with reference to the drawing, in which.

DETAILED DESCRIPTION

Figure 1:
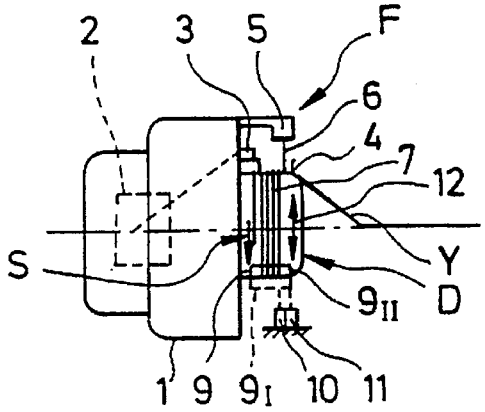
FIG. 1 is a side elevational view illustrating one embodiment of a weft-thread measuring feeder according to the invention.

A weft-thread measuring feeder F according to FIG. 1 includes a housing 1 which accommodates a drive motor 2 for a winding unit 3 that is adapted to be driven for rotation, as well as a stationary storage drum D. Storage drum D, which is, for instance, designed in the manner of a rod cage defines a circumferential surface 4 which has associated therewith a stop device 5 with a stop element 6. The stop element 6 can be moved between the illustrated holding position in which thread Y is prevented from being withdrawn and is retained, and a release position in which a section of thread Y can be withdrawn overend the storage drum D in the direction of the arrow from a thread stock 7 consisting of turns. A circumferentially defined part of storage drum D has arranged therein an elongated spreading body 9 which can be extended by means of a power accumulator S arranged within storage drum D from the passive position 9II, shown in full lines, into a spreading position 9I which projects beyond the adjacent circumferential surface 4 so as to enlarge the length of the turns. A trigger 10 is provided outside storage drum D for triggering power accumulator S or a lock 18 (FIG. 3) which holds spreading body 9.

Furthermore, a resetting means 11 is possibly provided for resetting spreading body 9 into the passive position 9II. The diameter of storage drum D can be adjusted (double-headed arrow 12).

Figure 2:
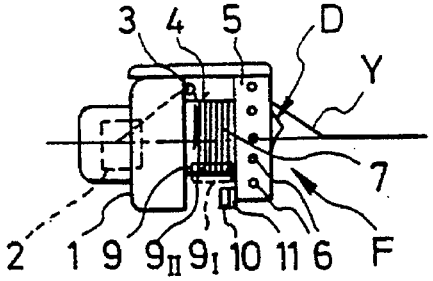
FIG. 2 is a side elevational view illustrating a second embodiment of a weft-thread measuring feeder according to the invention.

In the weft-thread measuring feeder F according to FIG. 2, motor 2 for winding unit 3 is accommodated in housing 1. With its circumferential surface 4, storage drum D defines a support for the turns in thread stock 7 from which thread Y can be withdrawn overend below stop device 5. The diameter of storage drum D is invariable. A plurality of stop elements 6 which can be operated selectively are distributed inside stop device 5 in the circumferential direction of storage drum D. The spreading body 9 can be extended by means of power accumulator S in storage drum D into the spreading position 9I in which it projects beyond the circumferential surface 4. The spreading body 9 can be returned into the passive position 9II (shown in full lines) in which it is flush with the circumferential surface 4 or even recedes behind said surface. Trigger 10 and resetting means 11 are for instance arranged on stop device 5.

In both measuring feeders F the spreading body 9 extends expediently in the direction of the drum axis to both sides beyond thread stock 7. Trigger 10 and resetting means 11, respectively, are operative in the area of thread stock 7 or at a place where in the engaged state of stop element 6 thread Y cannot move, i.e. in FIGS. 1 and 2 near the right end of storage drum D.

It can be seen in detail in FIGS. 3 to 12 how spreading body 9 is integrated into storage drum D.

Figure 3:
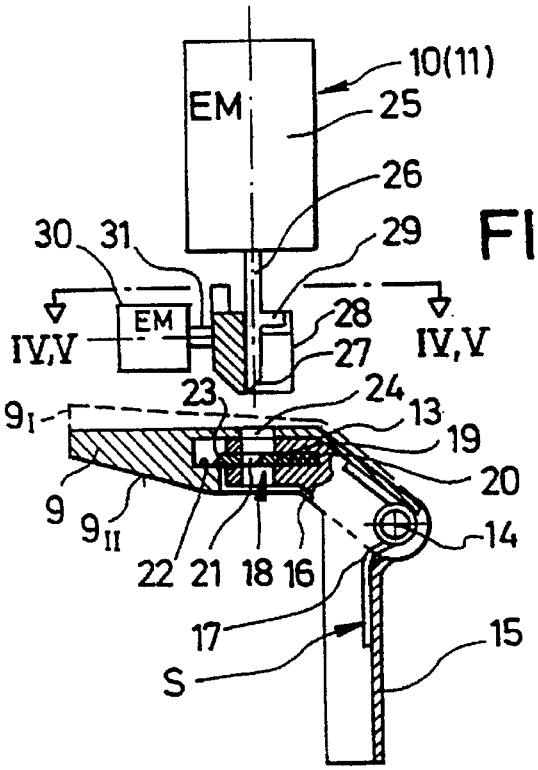
FIG. 3 is a partial cross-sectional view illustrating a spreading body and trigger of the weft-thread measuring feeders of FIGS. 1 and 2.
Figure 4:
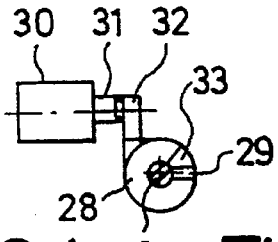
FIG. 4 is a top plan view in cross-section illustrating the trigger in one operating position as viewed in the direction of arrows IV—IV in FIG. 3.
Figure 5:
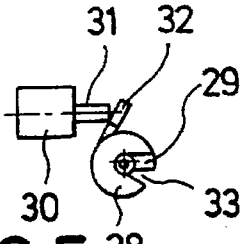
FIG. 5 is a top plan view in cross-section illustrating the trigger in another operating position as viewed in the direction of arrows V—V in FIG. 3.

In FIG. 3, the spreading body 9, which in its passive position 9II is drawn in full lines, is a finger 13 of the storage drum D formed as a rod cage and supported on an arm 15 to pivot about a pivot axis 14 which is approximately in parallel with the circumference of storage drum D. There may be provided stops (not shown), for instance on arm 15, to define positions 9I and 9II of spreading body 9. The stops can expediently be adjusted.

With an extension 16, arm 15 grips past spreading body 9 and includes a lock 18 for fixing spreading body 9 in the passive position 9II. Power accumulator S is a leg spring 17 on transverse axis 14 for moving spreading body 9 towards its spreading position 9I. Lock 18 has a slide 19 which is loaded by a spring 20 and grips over a countersurface 22 of spreading body 9 with a locking nose 23 and includes a trigger opening 21 which is accessible from the outside through an opening 24 in extension 16 and in spreading body 9.

Figure 6:
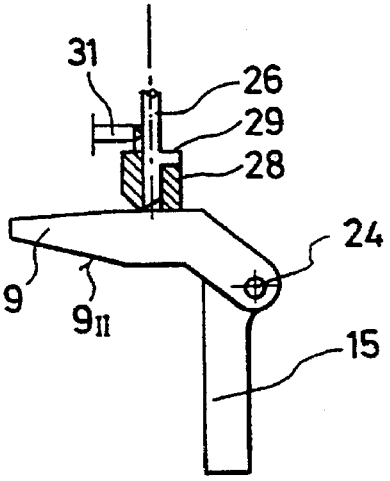
FIG. 6 is a partial side elevational view illustrating the trigger in a further operating position.

Trigger 10 which is arranged outside the storage drum and which in the illustrated embodiment serves as a resetting means 11 at the same time comprises, for instance, a solenoid 25 as a drive and a pin 26 with a pressure surface 27 as an actuator, with the pressure surface being oriented towards opening 21 and being pushed through opening 24 for triggering purposes until nose 23 slides off from countersurface 22 and power accumulator S moves spreading body 9 into spreading position 9I. Furthermore, pin 26 has provided thereat a pressure body 28 which according to FIGS. 4 and 5 has a lateral attachment 32 and can be rotated via an auxiliary drive 30, such as a solenoid, by means of a plunger 31 against the action of a spring. In the position illustrated in FIG. 3, pin 26 can be pushed downwards and upwards without pressure body 28, since a transverse attachment 29 of pin 26 can extend through a recess 33 of pressure body 28. When the auxiliary drive 30 is operated and pressure body 28 is rotated around pin 26, extension 29 will act on pressure body 28 in such a manner that the body can be mounted by means of pin 26 on spreading body 9 to reset the latter into the passive position 9II in which lock 18 becomes automatically operative (FIG. 6).

Figure 7:
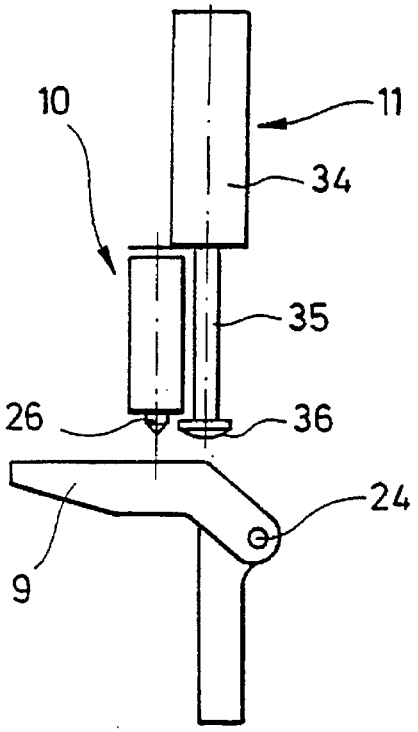
FIG. 7 is a side elevational view illustrating a second embodiment of the trigger.

In FIG. 7 mounting and locking of spreading body 9 correspond to those of FIG. 3. Pin 26 is driven by a solenoid or a pneumatic cylinder. Resetting means 11 is separated from trigger 10 and has a pneumatic cylinder 34 including a plunger 35 and a pressure plate 36 which is mounted on spreading body 9.

Figure 8:
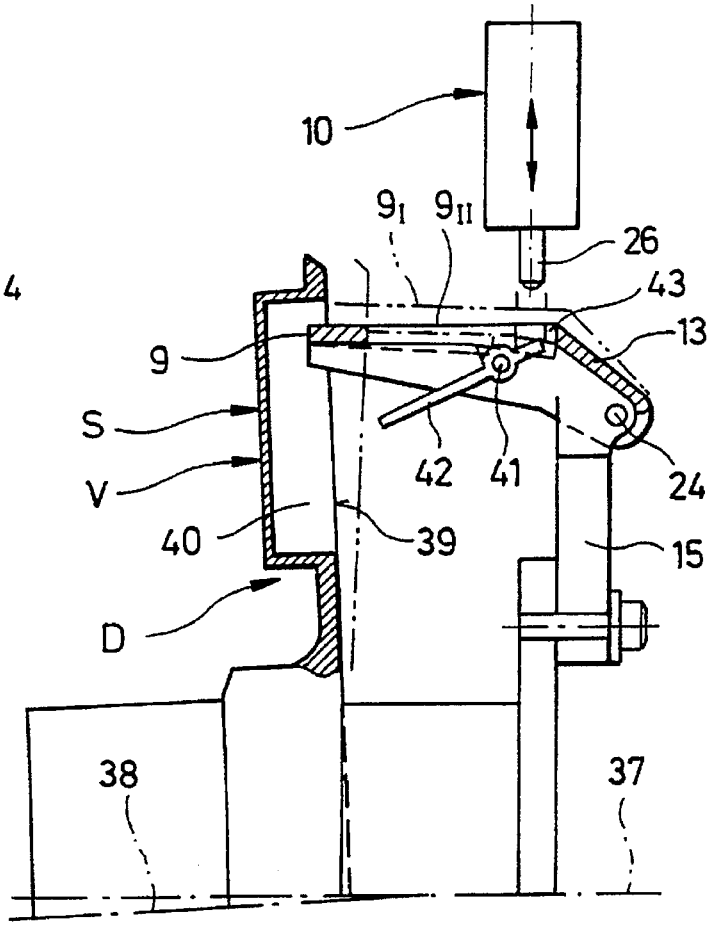
FIG. 8 is a side elevational view illustrating a further embodiment of the weft-thread measuring feeder.
Figure 9:
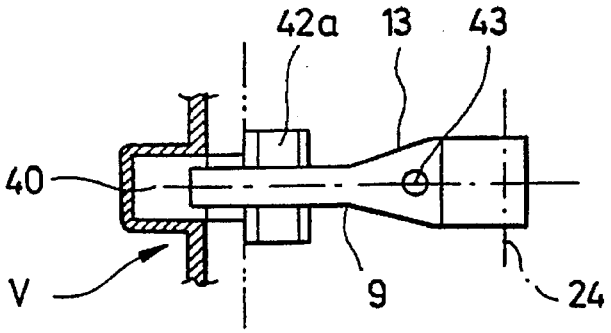
FIG. 9 is a top plan view in cross-section of the weft-thread measuring feeder of FIG. 8.

In the embodiment of FIGS. 8 and 9, spreading body 9 is pivotably supported with the transverse axis 17 on arm 15 of storage drum D. As can be seen, arm 15 can be displaced radially to vary the drum diameter. The storage drum axis is designated by 37. A disc-shaped advance element V whose rotational axis 38 is inclined relative to axis 37 is rotatably supported on a drive shaft (not shown in more detail) of the measuring feeder which is coaxial to axis 37. Advance element V is supported so as to be secured against co-rotation and performs a wobbling movement upon rotation of the drive shaft, the wobbling movement being exploited in a known manner for advancing the thread turns wound onto storage drum D upon rotation of the drive shaft. The advance element V is used with the axial component of its wobbling movement as a power accumulator S for moving spreading body 9 into spreading position 9I. To this end, a coupling element 42 can be pivoted in spreading body 9 in the manner of a two-armed lever about a transverse axis 41 against the action of a spring from the neutral position drawn in full lines into the coupling position drawn in dash-dotted lines, namely, for instance, by means of pin 26 of trigger 10. In the coupling position., coupling element 42 pushes with an enlarged end portion 42*a* against the front side 39 of the advance element in which an end of spreading body 9 projects into a recess 40. When advance element V abuts on coupling element 42, the spreading body is pivoted about the transverse axis 14 into the spreading position 9I and is held by a lock (not shown). Later on the spreading body will return into the passive position 9II either automatically, or it will be reset by the resetting means (not shown).

Figure 10:
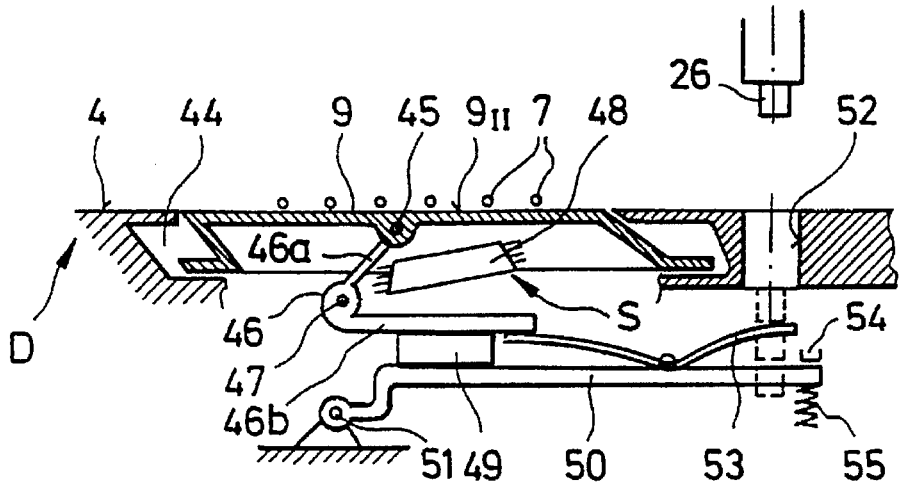
FIG. 10 is a side elevational view in cross-section illustrating a further embodiment of the spreading body in one operating position.
Figure 11:
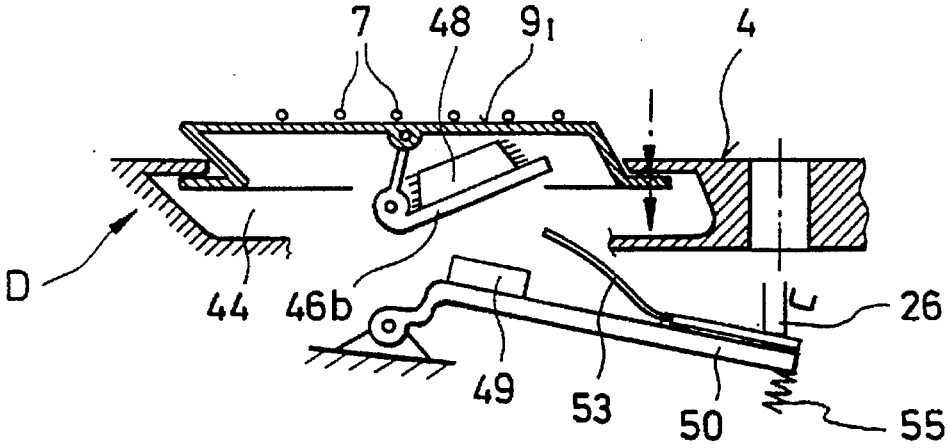
FIG. 11 is a side elevational view in cross-section illustrating the spreading body of FIG. 10 in a further operating position.

In the embodiment of FIGS. 10 and 11, the spreading body 9 is accommodated in a recess 44 of storage drum D. In the passive position 9II according to FIG. 10, it is approximately flush with the circumferential surface 4. In an axis 45 which is approximately in the circumferential direction of the storage drum, spreading body 9 is pivotable on a lever mechanism 48 which is constructed as a two-armed bent lever with an arm 46*a* and an armature member 46*b* forming the second arm and which is pivotable about a stationary transverse axis 46. Power accumulator S for extending spreading body 9 is a stationarily supported permanent magnet 48 which is oriented towards armature member 46*b*. A permanent magnet 49 which is supported on a release member 50, such as a release lever, to pivot about a transverse axis 51 serves to hold spreading body 9 in the passive position 9II. Pin 26 can act, through an opening 52 in storage drum D, on an end of release member 50 which is arranged between a stop 54 and a biasing spring 55. The biasing spring 55 presses release member 50 against Stop 54. A leaf spring 53, for instance, is pivotably held on release member 50, the leaf spring gripping below the projecting end of armature member 46*b* and helping to break the contact between armature member 46*b* and permanent magnet 49 when release member 50 is pivoted by pin 26, until armature member 46*b* is suddenly attracted by the permanent magnet 48.

In FIG. 11, spreading body 9 is extended into spreading position 9I in which it is supported with end stops 56 in recess 44 and held by the permanent magnet 48. Release member 50 is still pushed downwards by pin 26. Leaf spring 53 is in the lifted position in which armature member 46 is pushed away. As soon as pin 26 is retracted, release member 50 will return into the position of FIG. 10. As soon as the resetting means (not shown) pushes spreading body 9 back, armature member 46*b* will be disengaged from the permanent magnet 48 before permanent magnet 49 becomes operative.

Figure 12:
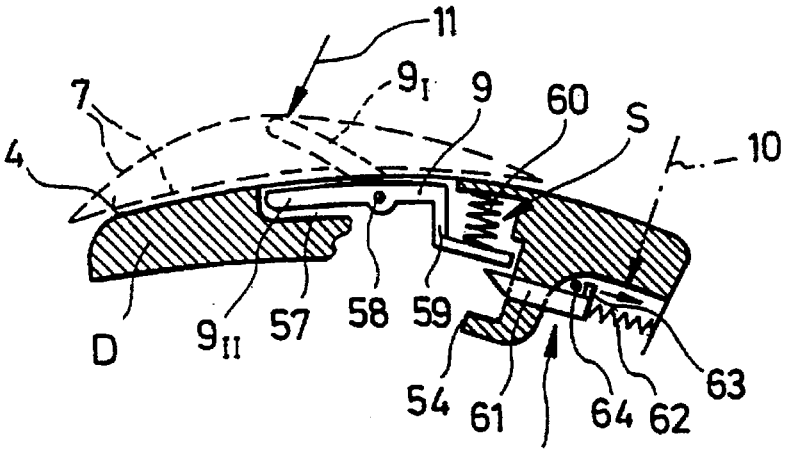
FIG. 12 is a side elevational view in cross-section illustrating another embodiment of the spreading body.

In the embodiment of FIG. 12, spreading body 9 is a flap 59 which can be pivoted into a recess 57 in storage drum D about an axis 58 which is in parallel with the axis of the storage drum. The spring accumulator S is a biased spring 60. Lock 18 keeps the spreading body in the passive position 9II, which is shown in full lines. As soon as an element 64 is moved-via trigger (10) (shown in dash-dotted line), a slide 61 which carries a nose 63 is moved away against the force of a spring 62 below spreading body 9. Spring 60 pivots the spreading body into the spreading position 9I shown in broken line, in which it is secured on a stop 54. The turns in thread stock 7 are extended in spreading position 9I. The resetting means 11 shown by an arrow returns flap 59, the latter being captured by slide 61 and locked.

It is possible to trigger the power accumulator also by contactless transmission of signals, for instance, by using a transmitter and a receiver.

Such triggering can be done during a picking cycle, for instance, in an inductive manner, by a radio signal, magnetically, by infrared light or by ultrasonic sound.

I claim:

1. In a weft-thread measuring feeder comprising a storage drum for receiving tangentially wound turns of a thread about the drum circumference and from which windings of said thread can be withdrawn over an end of said storage drum in successive sections of a predetermined thread length, said storage drum having a plurality of radially adjustable segments for varying a circumferential length of said drum circumference, and a stop device associated with said storage drum and comprising a stop element for dimensioning the thread length, comprising the improvement wherein said storage drum includes a spreading body which is positioned radially inwardly of said windings of said thread to define a fraction of the drum circumference, said spreading body being elongated approximately in parallel with the drum axis and being temporarily radially extendable relative to said radially adjustable segments from a retracted passive position into a spreading position which projects radially outwardly beyond a circumferentially adjacent portion of the drum circumference defined by said radially adjustable segments to increase said circumferential length, said storage drum having therein a triggerable extension-type power accumulator for extending said spreading body to said spreading position.

2. The weft-thread measuring feeder according to claim 1, wherein said storage drum is a rod cage with a plurality of axial fingers which are circumferentially spaced apart and define said radially adjustable segments, said spreading body being supported on one of said fingers or between adjacent fingers.

3. A weft-thread measuring feeder comprising a storage drum and a stop device, said storage drum having an invariable outer diameter to define a circumferential length of the drum circumference for receiving tangentially wound turns of a thread and from which windings of said thread stock can be withdrawn over an end of said storage drum in successive sections of a predetermined thread length, said stop device being associated with said storage drum and comprising a plurality of stop elements evenly distributed over the drum circumference for dimensioning the thread length, comprising the improvement wherein said storage drum includes a spreading body which is positioned radially inwardly of said windings of said thread to define a fraction of the drum circumference, said spreading body being elongated approximately in parallel with the drum axis and being temporarily radially extendible relative to the circumferentially adjacent portion of the drum circumference from a retracted passive position into a spreading position which projects radially outwardly beyond the circumferentially adjacent portion of the drum circumference to increase said circumferential length, said storage drum having therein a triggerable extension type power accumulator for extending said spreading body.

4. The weft-thread measuring feeder according to claim 3, wherein said spreading body is movable in an approximately parallel position relative to the axis of said storage drum radially or is movable about a pivotal axis which is perpendicular to a longitudinal direction of said storage drum or in parallel with said longitudinal direction.

5. The weft-thread measuring feeder according to claim 4 wherein said actuator means includes a spring element and said spreading body comprises an axial finger of said storage drum which is supported on a storage drum arm so as to be pivotable to a limited degree and is biased towards said spreading position by said spring element, an automatically latching lock being provided between said arm and said spreading body which can be released against the action of a spring and which fixes said spreading body in said passive position.

6. A weft-thread measuring feeder comprising a storage drum for receiving thread, said storage drum having a drum circumference which defines a circumferential length for receiving windings of said thread thereon and from which windings of said thread can be withdrawn over an end of said storage drum, a stop device associated with said storage drum and disposed proximate the drum circumference for dimensioning the thread length being withdrawn, said storage drum also including a spreading body which is positioned radially inwardly of said winding, of said thread to circumferentially define a movable portion of the drum circumference which is disposed between circumferentially adjacent portions of the drum circumference, said spreading body extending approximately in parallel with the drum axis and being radially movable relative to the circumferentially adjacent portions of the drum circumference between a retracted passive position and a spreading position which projects radially outwardly beyond said circumferentially adjacent portions of the drum circumference to increase said circumferential length, said storage drum having therein actuator means for moving said spreading body outwardly relative to said circumferentially adjacent portions at least to said spreading position, said storage drum having an invariable outer surface so that said circumferentially adjacent portions of the drum circumference are radially fixed, said spreading body being radially movable relative to said circumferentially adjacent portions.

7. The weft-thread measuring feeder according to claim 6, wherein said spreading body comprises an axial finger of said storage drum which is supported on a storage drum arm so as to be pivotable to a limited degree, said actuator means being a power accumulator which is adapted to act on said spreading body, said storage drum including an advance element which can be driven in a wobbling fashion relative to said storage drum, said spreading body having thereon a coupling element which has pivot means so as to be movable against the action of a spring into an entrainment position, said coupling element positioned proximate said advance element so as to be acted upon by said advance element in said entrainment position and pivot said spreading body into said spreading position which is defined by releasable locking means.

8. The weft-thread measuring feeder according to claim 6, wherein said spreading body is movably supported substantially in parallel with the axis of said storage drum on a lever mechanism in a recess of said storage drum which positively defines said passive and spreading positions, said actuator means being at least a stationary permanent magnet which cooperates with an armature member of said lever mechanism, another permanent magnet being arranged on a release member so as to be moveable therewith, said release member being actuated from outside said storage drum for locking said spreading body in said passive position.

9. The weft-thread measuring feeder according to claim 6, wherein said actuator means is a power accumulator which is formed as a spring element and said spreading body is a flap which is pivotable to a limited degree in said finger or in a recess of said storage drum about an axis approximately in parallel with said drum axis under the action of said power accumulator, a springloaded, automatically latching lock being provided which is unlockable from outside said storage drum.

10. The weft-thread measuring feeder according to claim 6, wherein outside of said storage drum and at a distance from said drum circumference, a trigger which is operable between picking cycles is provided having means for triggering said actuator means with an electromagnetic, mechanical, or pressurized drive.

11. The weft-thread measuring feeder according to claim 10, wherein an auxiliary drive is provided at said trigger, and said trigger is additionally formed as a resetting means, said trigger being switchable between a release function and a resetting function by means of said auxiliary drive.

12. The weft-thread measuring feeder according to claim 6, wherein outside said storage drum a resetting means is provided for acting at least on said spreading body extended into said spreading position so as to reset said spreading body in said passive position, said resetting means having an electromagnetic, electromotive, mechanical, or pressurized drive.

13. A weft-thread measuring feeder comprising a storage drum for receiving thread, said storage drum having a drum circumference which defines a circumferential length for receiving windings of said thread thereon and from which windings of said thread can be withdrawn over an end of said storage drum, a stop device associated with said storage drum and disposed proximate the drum circumference for dimensioning the thread length being withdrawn, said storage drum also including a spreading body which is positioned radially inwardly of said windings of said thread to circumferentially define a movable portion of the drum circumference which is disposed between circumferentially adjacent portions of the drum circumference, said spreading body extending approximately in parallel with the drum axis and being radially movable relative to the circumferentially adjacent portions of the drum circumference between a retracted passive position and a spreading position which projects radially outwardly beyond said circumferentially adjacent portions of the drum circumference to increase said circumferential length, said storage drum having therein actuator means for moving said spreading body outwardly relative to said circumferentially adjacent portions at least to said spreading position, said storage drum including a plurality of radially adjustable segments which define said circumferentially adjacent portions of said drum circumference, said spreading body being connected to said radially adjustable segments so that said radially adjustable segments and said spreading body disposed in said passive position define a first said circumferential length, said spreading body being radially movable relative to said radially adjustable segments so as to increase said circumferential length and define a second said circumferential length.

14. The weft-thread measuring feeder according to claim 13, wherein said spreading body comprises an axial finger of said storage drum which is supported on a storage drum arm so as to be pivotable to a limited degree, said actuator means being a power accumulator which is adapted to act on said spreading body, said storage drum including an advance element which can be driven in a wobbling fashion relative to said storage drum, said spreading body having thereon a coupling element which has pivot means so as to be movable against the action of a spring into an entrainment position, said coupling element positioned proximate said advance element so as to be acted upon by said advance element in said entrainment position and pivot said spreading body into said spreading position which is defined by releasable locking means.

15. The weft-thread measuring feeder according to claim 13, wherein said spreading body is movably supported substantially in parallel with the axis of said storage drum on a lever mechanism in a recess of said storage drum which positively defines said passive and spreading positions, said actuator means being at least a stationary permanent magnet which cooperates with an armature member of said lever mechanism, another permanent magnet being arranged on a release member so as to be moveable therewith, said release member being actuated from outside said storage drum for locking said spreading body in said passive position.

16. The weft-thread measuring feeder according to claim 13, wherein said actuator means is a power accumulator which is formed as a spring element and said spreading body is a flap which is pivotable to a limited degree in said finger or in a recess of said storage drum about an axis approximately in parallel with said drum axis under the action of said power accumulator, a springloaded, automatically latching lock being provided which is unlockable from outside said storage drum.

17. The weft-thread measuring feeder according to claim 13, wherein outside of said storage drum and at a distance from said drum circumference, a trigger which is operable between picking cycles is provided having means for triggering said actuator means with an electromagnetic, mechanical, or pressurized drive.

18. The weft-thread measuring feeder according to claim 17, wherein an auxiliary drive is provided at said trigger, and said trigger is additionally formed as a resetting means, said trigger being switchable between a release function and a resetting function by means of said auxiliary drive.

19. The weft-thread measuring feeder according to claim 13, wherein outside said storage drum a resetting means is provided for acting at least on said spreading body extended into said spreading position so as to reset said spreading body in said passive position, said resetting means having an electromagnetic, electromotive, mechanical, or pressurized drive.

* * * * *

UNITED STATES PATENT AND TRADEMARK OFFICE

CERTIFICATE OF CORRECTION

PATENT NO. : 5,623,973

DATED : April 29, 1997

INVENTOR(S) : Paer Josefsson

It is certified that error appears in the above-indentified patent and that said Letters Patent is hereby corrected as shown below:

On the title page, Section [87], line 2;
change "June 9, 1995" to ---June 9, 1994---.

Column 8, line 17; after "claim 4" insert ---,---.

Column 8, line 35; change "winding," to ---windings---.

Signed and Sealed this

Fourteenth Day of April, 1998

Bruce Lehman

*Attest:*

BRUCE LEHMAN

*Attesting Officer*

*Commissioner of Patents and Trademarks*